US008961153B2

(12) United States Patent
Wilson

(10) Patent No.: US 8,961,153 B2
(45) Date of Patent: Feb. 24, 2015

(54) SUBSEA INJECTION SYSTEM

(75) Inventor: Steven S. Wilson, Inverness (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1454 days.

(21) Appl. No.: 12/040,135

(22) Filed: Feb. 29, 2008

(65) Prior Publication Data

US 2009/0217992 A1 Sep. 3, 2009

(51) Int. Cl.

| | |
|---|---|
| ***F04B 35/04*** | (2006.01) |
| ***F04B 53/20*** | (2006.01) |
| ***E21B 43/01*** | (2006.01) |
| ***E21B 43/013*** | (2006.01) |
| ***E21B 43/20*** | (2006.01) |
| ***F04D 29/70*** | (2006.01) |
| ***F04D 13/08*** | (2006.01) |

(52) U.S. Cl.

CPC ..... *F04D 29/708* (2013.01); *E21B 43/01* (2013.01); *E21B 43/20* (2013.01); *F04D 13/086* (2013.01)

USPC ..... 417/423.3; 417/61; 166/105; 166/268; 166/266

(58) Field of Classification Search

CPC ..... F04D 13/066; E21B 43/128; E21B 43/20

USPC ..... 417/410.1, 430, 61, 423.3; 166/368, 166/369, 263, 266, 268, 350, 335, 105, 166/275; 137/565.01; 210/242.1, 170.11, 210/170.04; 92/48, 168

See application file for complete search history.

(56) References Cited

U.S. PATENT DOCUMENTS

| | | | | | |
|---|---|---|---|---|---|
| 167,546 | A | * | 9/1875 | Lefferts | 210/170.01 |
| 291,285 | A | * | 1/1884 | Breese | 210/242.1 |
| 616,364 | A | * | 12/1898 | Shreeve | 210/284 |
| 1,647,809 | A | * | 11/1927 | Neumann | 210/242.1 |
| 1,909,578 | A | * | 5/1933 | Coard | 417/61 |
| 2,832,512 | A | * | 4/1958 | Brooks | 222/376 |
| 3,108,146 | A | * | 10/1963 | Gross | 261/24 |
| 3,515,215 | A | * | 6/1970 | Christensen et al. | 166/268 |
| 3,631,880 | A | * | 1/1972 | Hansel | 137/172 |
| 4,024,063 | A | * | 5/1977 | Mori | 210/242.1 |
| 4,116,009 | A | * | 9/1978 | Daubin | 114/264 |
| 4,224,162 | A | * | 9/1980 | Ayroldi | 210/242.1 |
| 4,238,335 | A | * | 12/1980 | Grimsley | 210/802 |
| 4,462,766 | A | * | 7/1984 | Carlsson et al. | 417/430 |
| 4,797,063 | A | * | 1/1989 | Lott | 415/116 |
| 4,844,156 | A | * | 7/1989 | Hesh | 166/263 |
| 4,848,471 | A | * | 7/1989 | Bencze | 166/335 |
| 5,040,601 | A | * | 8/1991 | Karlsson et al. | 166/278 |
| 5,154,741 | A | * | 10/1992 | da Costa Filho | 96/157 |
| 5,203,682 | A | | 4/1993 | Inklebarger | |
| 5,554,897 | A | * | 9/1996 | Martin et al. | 310/54 |
| 5,624,238 | A | * | 4/1997 | Herbert | 417/61 |

(Continued)

FOREIGN PATENT DOCUMENTS

| | | | |
|---|---|---|---|
| GB | 2067234 | A | 7/1981 |
| GB | 2419924 | A | 5/2006 |

(Continued)

*Primary Examiner* — Alexander Comley

(74) *Attorney, Agent, or Firm* — Michael Stonebrook

(57) ABSTRACT

A subsea, seawater injection system, positionable on a seabed for connection to a subterranean well includes a frame, an electrical submersible pump (ESP) positioned in the frame so as to be oriented substantially parallel to the seabed when positioned thereon, and a filter operationally positioned between a source water intake and the ESP.

17 Claims, 1 Drawing Sheet

(56) References Cited

U.S. PATENT DOCUMENTS

| | | | | |
|---|---|---|---|---|
| 6,059,539 | A * | 5/2000 | Nyilas et al. | 417/228 |
| 6,062,259 | A * | 5/2000 | Poirier | 137/563 |
| 6,171,483 | B1 * | 1/2001 | Eden et al. | 210/170.11 |
| 6,406,621 | B1 * | 6/2002 | Bates et al. | 210/170.05 |
| 6,454,010 | B1 * | 9/2002 | Thomas et al. | 166/369 |
| 6,457,522 | B1 * | 10/2002 | Bangash et al. | 166/267 |
| 6,688,392 | B2 * | 2/2004 | Shaw | 166/366 |
| 6,709,582 | B2 * | 3/2004 | Danner | 210/170.02 |
| 6,849,988 | B2 | 2/2005 | Rueger | |
| 6,973,973 | B2 * | 12/2005 | Howard et al. | 166/372 |
| 7,249,634 | B2 * | 7/2007 | de Albuquerque Lima Goncalves et al. | 166/335 |
| 7,395,864 | B2 * | 7/2008 | Ramachandran et al. | 166/310 |
| 2001/0007283 | A1 * | 7/2001 | Johal et al. | 166/265 |
| 2003/0145991 | A1 * | 8/2003 | Olsen | 166/265 |
| 2004/0007881 | A1 * | 1/2004 | Kobashikawa et al. | 290/53 |
| 2005/0023222 | A1 * | 2/2005 | Baillie | 210/651 |
| 2005/0217857 | A1 | 10/2005 | Rodrigues et al. | |
| 2006/0118310 | A1 * | 6/2006 | Euphemio et al. | 166/368 |
| 2006/0157241 | A1 * | 7/2006 | Rodrigues et al. | 166/268 |
| 2006/0162934 | A1 * | 7/2006 | Shepler | 166/370 |
| 2006/0243670 | A1 * | 11/2006 | Pinchin | 210/748 |
| 2007/0090039 | A1 * | 4/2007 | Young et al. | 210/321.6 |
| 2007/0187110 | A1 * | 8/2007 | Lima Goncalves et al. | 166/368 |

FOREIGN PATENT DOCUMENTS

| | | | |
|---|---|---|---|
| WO | 2006039719 | A2 | 4/2006 |
| WO | 2007118170 | A1 | 10/2007 |

* cited by examiner

SUBSEA INJECTION SYSTEM

TECHNICAL FIELD

The present invention relates in general to pumping systems and by example to an injection system for deployment below the surface of a water body for injecting fluid into a subterranean formation.

BACKGROUND

A secondary means of recovering hydrocarbons from an oil or gas field is to inject water into the subterranean reservoir to maintain reservoir pressure and to drive certain fractions of the hydrocarbons to producing wells. Water flooding operations require in general, a sufficient supply of water for injection; means for treating the source water to meet the reservoir conditions; a pump system; and access to the formation via a wellbore. In land based operations the source of the water is commonly from fluid produced from the subject reservoir; water treatment facilities can be readily constructed and accessed; and traditional pumping equipment is readily available. Water flooding conducted in marine operations presents drawbacks that can preclude the use of water flooding to obtain currently available hydrocarbon reserves.

Marine operations, being those in which the wellbore is below a water body and access to the wellbore is primarily via a platform or water craft, present logistical and economic limitations. In current offshore or marine water flood operations the water source is often produced well water that is processed and boosted via the platform facilities to attain the required injection pressure. Occasionally seawater is recovered, treated and then injected into the well from a platform.

Most producing fields involve numerous spaced apart wells and the injection wells are often positioned on the perimeter of the reservoir. Thus, the injections wells are typically positioned well away from the field pumping facilities requiring that utilization of centralized injections platforms connected to the various injection wells via submarine pipelines. It is therefore a desire to provide a pumping system that may be positioned at a point of need, below the surface of a body of water, for the purposes such as, without limitation, injecting raw seawater into one or more subterranean wells, producing a fluid from a wellbore, propelling a pig for pigging pipelines or dewatering flooded pipelines

SUMMARY

An example of a pumping system includes a frame and a pump having an intake and a discharge, the pump being mounted within the frame such that the pump is oriented substantially parallel to the surface upon which the frame is supported. The pump and frame may be positioned below the surface of a body of water and the discharge of the pump connected to a wellbore. The pump and the frame may be positioned below the surface of a body of water and the discharge of the pump connected to a pipeline. The pump and the frame may be positioned below the surface of a body of water and the intake of the pump connected to a wellbore or pipeline An example of a subsea, seawater injection system positionable on a seabed for connection to a subterranean well includes a frame, an electrical submersible pump (ESP) positioned in the frame so as to be oriented substantially parallel to the seabed when positioned thereon, and a filter operationally positioned between a source water intake and the ESP.

An example of a subsea raw seawater injection system includes an electric submersible pump having a discharge connected to a subterranean well, the electric submersible pump being positioned at, and substantially parallel to, a seabed; a seawater intake positioned above the seabed; and a filter operationally connected between the seawater intake and the electric submersible pump.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
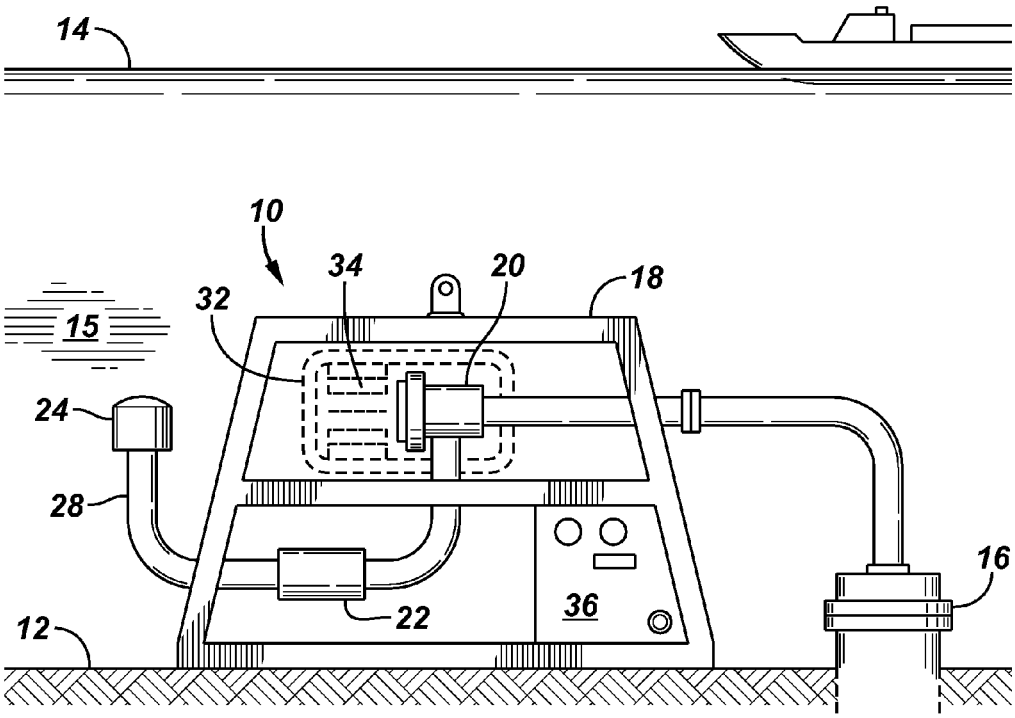
FIG. 1 is a conceptual view of an example of a subsea injection system of the present invention.

Refer now to the drawings wherein depicted elements are not necessarily shown to scale and wherein like or similar elements are designated by the same reference numeral through the several views.

The system is described herein as a seawater injection system and is primarily described in terms of utilization as a point of injection seawater injection system. As will be better understood in the further description below, the present system is adapted for deployment subsea, permanently or temporarily, and may be utilized for various pumping applications. For example, and without limitation, the system may be utilized for boosting the fluid production from a wellbore into a pipeline or to a production facility, for dewatering pipelines or wells, and for pipeline pigging.

FIG. 1 is a conceptual view of an example of a subsea injection system of the present invention, generally denoted by the numeral 10. Injection system 10 is positioned on a seabed 12, below the surface 14 of the water 15. For purposes of brevity, the body of water and other related terms are described in terms of the sea, and it should be recognized that the system may be utilized in fresh water as well.

System 10 is illustrated as a point of injection system, positioned at or proximate to an injection well or wellbore 16. System 10 includes a deployment skid denoted generally by the numeral 18. Skid 18 is a frame structure adapted for containing and supporting various sub-systems and apparatus of system 10. As will be further noted below, various subsystems and apparatus may be modular to facilitate maintenance and replacement in a subsea environment.

Figure 2:
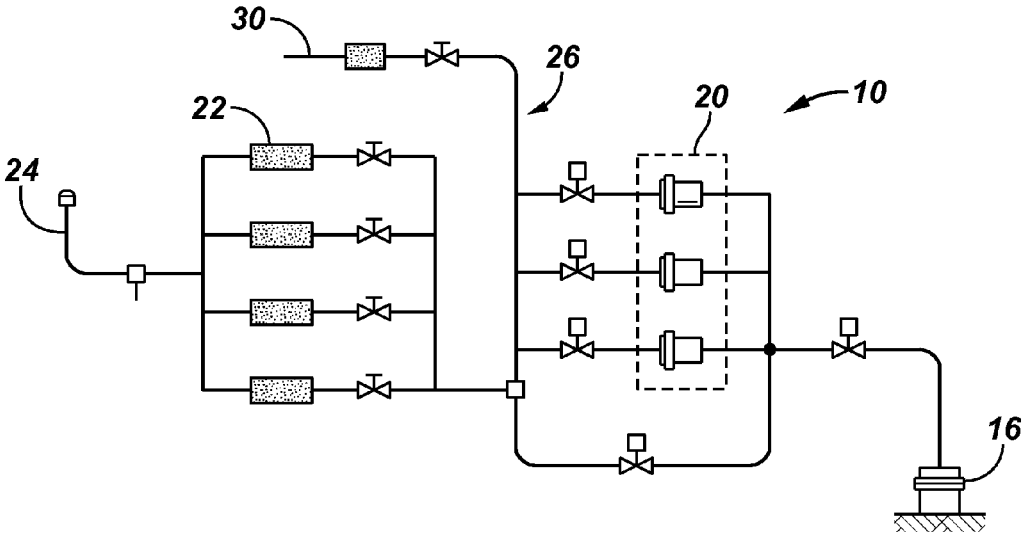
FIG. 2 is a conceptual piping diagram of an example of a subsea injection system of the present invention.

Refer now to FIG. 2 wherein a conceptual piping diagram of subsea injection system 10 is provided. System 10 includes an injection pump 20, a filter 22, an intake 24, and a manifold 26. FIG. 2 illustrates system 10 having multiple pumps 20 and multiple filters 22. System 10 may include pump systems and filtration systems as illustrated in FIG. 2 or may comprise a single pump and or filter as desired for the particular installation. For purposes of clarity, pump and pump system are both identified by the numeral 20, and filter and filter system are identified by the numeral 22.

Referring now to FIGS. 1 and 2, injection system 10 is operationally described. In the present example, intake 24 is buoyantly positioned in the water 15 column and is in fluid connection with well(s) 16 via piping 28. Water 15 is drawn in through intake 24 into filters 22 and is injected into well 16 via pumps 20. Manifold 26 may include various valves and control systems for controlling the flow of water 15 through the system. For example, fluid 15 may be directed to one or more wells 16, through a discharge 30, or routed through one or more of pumps 20.

Filters 22 are sized to pass source water 15 at a sufficient flow rate, for example 15,000 to 20,000 barrels per day, without plugging filters 22 or causing unnecessary friction loss. Filters 22 may be conventional downhole premium screens laid in a horizontal fashion. Filters 22 are utilized to prevent debris from being injected into well 16.

Pump 20 is an electrical submersible pump (ESP) that is commonly used in the petroleum industry for positioning at the bottom of a wellbore for producing a fluid. It is conceived that the ESP may be positioned horizontal relative to seabed 12 when it is deployed. Traditionally ESPs are positioned vertically in a wellbore. The present system orients pumps 20 such that when the system is deployed, pumps 20 are positioned substantially parallel to the surface upon which they are landed. For example, in FIG. 1 pumps 20 are substantially parallel to seabed 12.

Referring to FIG. 1, ESP 20 is disposed within a pressure balanced canister 32 (shown by dashed lines) to provide for motor cooling and to contain any pumped or motor protection fluids that may leak from release into the marine environment. Canister 32 may include a pump cooling mechanism 34. For example, cooling mechanism 34 may be fins (FIG. 1) mounted internally in canister 32 to facilitate circulation in canister 32 due to natural convection. Pumps 20 may be utilized singularly, in series, or in parallel, as desired.

System 10 may further include an operation system or package generally denoted by the numeral 36 in FIG. 1. Operation package 36 may include, without limitation: hydraulic power; hydraulic control systems; an electrical source; electrical control systems; system monitoring systems; data collections systems; data and control communication systems; and a electro-hydraulic stab plate for linking to a submarine umbilical.

Referring back to FIG. 1, system 10 is provided as a modular or skid 18 system. Electric submersible pumps 20 may be provided so as to be removed as a cartridge or module for repair or replacement. Filters 22 are positioned below pumps 20.

Electrical submersible pumps 20 are positioned so as to operate in a horizontal position (relative to the seabed) when deployed as opposed to the traditional vertical orientation of ESPs. The horizontal orientation enables a rapid build and deployment of the system and eliminates the need for precision placement of the system atop the wellbore. In the illustrated example, system 10 is deployed proximate to well 16 via a work ship. Once on the sea floor system 20 can be piped to well 16 and intake 24 deployed in the water column.

From the foregoing detailed description of specific embodiments of the invention, it should be apparent that a point of need pumping system that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A subsea, raw seawater injection system comprising:

an electric submersible pump having a discharge connected to a subterranean well, the electric submersible pump positioned at and substantially parallel to a seabed;

a seawater intake buoyantly supported in a water column above the seabed to draw seawater from the water column; and a filter operationally connected between the seawater intake and the electric submersible pump, the filter positioned below the pump relative to the seabed.

2. The system of claim 1, further including a pressure equalized canister positioned about the pump in a manner to contain a pump protector fluid.

3. The system of claim 2, further including a pump cooling mechanism positioned within the canister.

4. The system of claim 3, wherein the cooling mechanism includes fins.

5. The system of claim 1, wherein the filter is positioned inside of a frame that is located on the seabed and the water intake is positioned outside of the frame.

6. The system of claim 5, further including a pressure equalized canister positioned about the pump in a manner to contain a pump protector fluid.

7. The system of claim 1, further comprising a frame located on the seabed, wherein the electric submersible pump and the filter are positioned inside of the frame and the water intake is positioned outside of the frame.

8. A method comprising:

drawing water from a water column between a seabed and a water surface through a water intake into a pump positioned at the seabed, wherein the water intake is buoyantly supported in the water column above the seabed;

filtering the water between the water intake and the pump, wherein a filter is located below the pump relative to the seabed; and injecting the filtered water from a discharge of the pump into a subterranean well formed in the seabed.

9. The method of claim 8, wherein the pump is an electric submersible pump.

10. The method of claim 8, wherein the pump is positioned substantially parallel to the seabed.

11. The method of claim 8, wherein an equalized canister is positioned about the pump in a manner to contain a pump protector fluid.

12. The method of claim 11, wherein the pump is an electric submersible pump.

13. The method of claim 12, further including a pump cooling mechanism positioned within the canister.

14. The method of claim 8, wherein the pump is positioned inside of a frame located on the seabed.

15. The method of claim 14, wherein the filter is positioned inside of the frame and the water intake is positioned outside of the frame.

16. A subsea raw seawater injection system for use with a subterranean well beneath a seabed, the system comprising:

an electric submersible pump to be positioned at the seabed with its longitudinal axis substantially parallel to the seabed, the pump having a seawater intake arranged to be positioned, in use, above the seabed and below the surface of the seawater;

a filter connected with a tubular conduit so as to be operationally connected between the seawater intake and the pump, the filter located below the pump;

a discharge from the pump, the discharge to connect to the subterranean well whereby, in use, raw seawater is drawn into the pump through the seawater intake and the filter and injected into the subterranean well; and a frame to stand on the seabed, whereby the pump is mounted inside of the frame and the seawater intake is located outside of the frame.

17. The system of claim 16, wherein the filter is located inside of the frame.

* * * * *